US005591012A

United States Patent [19]

Langguth et al.

[11] Patent Number: 5,591,012

[45] Date of Patent: Jan. 7, 1997

[54] CONVEYING PUMP FOR SUPPLY CONTAINERS OF VARIOUS HEIGHTS

[75] Inventors: Peter Langguth; Ewald Kille, both of Friedrichshafen, Germany

[73] Assignee: J. Wagner GmbH, Friedrichshafen, Germany

[21] Appl. No.: 271,523

[22] Filed: Jul. 7, 1994

[30] Foreign Application Priority Data

Jul. 15, 1993 [DE] Germany ..... 43 23 733.9

[51] Int. Cl.[6] ..... F04B 19/00

[52] U.S. Cl. ..... 417/238; 417/360; 417/570; 222/379; 222/382; 222/385; 92/59

[58] Field of Search ..... 417/238, 360, 417/570; 92/59; 222/189, 333, 379, 382, 385

[56] References Cited

U.S. PATENT DOCUMENTS

| | | | |
|---|---|---|---|
| 150,679 | 5/1874 | Fairbanks | 417/570 |
| 368,983 | 8/1887 | Thompson, Jr. | 222/379 |
| 694,645 | 3/1902 | Howard | 222/379 |
| 764,573 | 3/1904 | Furru | 417/238 |
| 1,641,280 | 9/1927 | Joslin et al. | 222/382 |
| 5,366,642 | 11/1994 | Platter et al. | 417/238 |

FOREIGN PATENT DOCUMENTS

| | | |
|---|---|---|
| 3540984 | 5/1987 | Germany . |
| 61-200182 | 12/1986 | Japan . |
| 564152 | 7/1975 | Switzerland . |

*Primary Examiner*—Charles G. Freay
*Attorney, Agent, or Firm*—Hill, Steadman & Simpson

[57] ABSTRACT

In a conveying pump having a cylinder introducible into a reservoir and having a pump piston, whereby the conveyed medium is supplied via an ascending line to a discharge line, an ascending line formed of two sections adjustable relative to one another is provided. The ascending line can be locked at different heights to vary the length of the ascending line so that the conveying pump can be used for reservoirs of different heights without deteriorating the conveying capacity of the pump. This adaptation can be performed easily and quickly. In addition, the conveying pump can be taken apart and easily cleaned, and component parts can be easily replaced.

22 Claims, 5 Drawing Sheets

16"
16'
16
20
31
23
33
32
21
15
28"
30
26
12
27
28'
29
28
14
25
22
13
19
46
17
11
45
18

16"
16'
16
20
31
23'
33
32
21'
29'
15
25'
30'
12
24
14
22'
13
19
46
17
11
45
18

16''
16'
16
20
31
23''
33
32
21''
15
28''
30
26
12
27
28'
29
28
25
14
22''
13
19
46
17
45
11''
18

CONVEYING PUMP FOR SUPPLY CONTAINERS OF VARIOUS HEIGHTS

BACKGROUND OF THE INVENTION

The invention is directed to a conveying pump, particularly for paints and similar media, composed of a cylinder that is introducible into a reservoir and is provided with an admission valve and a discharge valve, and composed of a pump piston arranged in the cylinder and driveable by a motor, for example, via a cam lever or crank mechanism, whereby the conveyed medium can be supplied to a discharge line via an ascending pipe connected to the valve housing that accepts the discharge valve.

Japanese Utility Model Sho-61-200182 discloses a conveying pump of this type with which the medium to be processed can be supplied from a reservoir to a paint roller. The ascending pipe is formed by the connection piece attached to the valve housing of the discharge valve as well as to the discharge line and by an adaptor put in place on said connection piece. Apart from the fact that the connections between the connection piece attached to the valve housing and the adaptor, as well as between the latter and the connection piece provided at the discharge line, must be sealed, a lateral offset of the connection pieces that are not arranged in alignment with one another must be compensated by the adaptor. The slight deflections of the flow of the conveyed medium are in fact insignificant; what, by contrast, is disadvantageous is that the length of the suction line, which is composed of three component parts rigidly connected to one another, cannot be varied in a simple way, the known conveying pump thus being employable only for a prescribed overall height of the reservoir and, consequently, not being selectively employable for different apparatus.

DE-A1-35 40 984 as well as CH-A5-564 152 disclose that a pipe extension be slipped onto a riser pipe given an ascending line or, respectively, given a cover that follows the level of the medium to be pumped, and, thus, that lies thereon, to hold this cover with a tube section guided in gliding fashion; these embodiments, however, cannot be applied given conveying pumps of the type initially described above.

SUMMARY OF THE INVENTION

It is therefore an object of the invention to provide a conveying pump of the type initially described in such a way that the pump can be utilized for the complete emptying of reservoirs that differ in height without the flow rate of the pump being deteriorated. The matching to the respective height of the reservoir should be capable of being undertaken in an extremely simple way and in a short time; nonetheless, what is always a reliable interlock of the individual component parts and, thus, a dependable function of the conveying pump should be assured and the pump should be easy to take apart in order to clean the component parts thereof without difficulty and/or in order to be able to replace wear parts thereof as warranted. Further, the structural outlay should be kept low; the conveying pump should also be economically manufacturable.

These and other objects are inventively achieved in a conveying pump of the afore-mentioned type in that the ascending line is formed of two or more sections adjustable relative to one another in order to vary the length of said ascending line, these sections being lockable in different heights; or in that the ascending line is composed of two sections that can be plugged inside one another and can be locked to one another, at least one thereof being optionally dimensioned different in length.

It is thereby expedient to form the sections of the ascending line with connection pieces that are arranged in alignment with one another and can be plugged into one another, the connection pieces being attached to the valve housing of the discharge valve and to the discharge line.

For locking the connection pieces, it is advantageous to attach an adjusting lever that is elastically deformable and extends in the direction of the ascending line to the valve housing of the discharge valve or to the discharge line, that side of the adjusting lever that faces toward the connection piece being provided with a catch nose that respectively engages into one of the notches formed in the outside generated surface of one of the connection pieces at different levels, whereby the adjusting lever should be provided with a gripping member applied angled at that side lying opposite the catch nose.

It is also indicated that the connection pieces that form the ascending line be displaceably guided inside one another in anti-twist fashion, for example, with a web that projects from the cylinder and engages into a longitudinal channel formed in the outside generated surface of the connection piece attached to the discharge line.

In order to prevent the dead space of the cylinder from being enlarged, the piston rod allocated to the pump piston should be connectible to the drive element of the motor at different heights in order to compensate a change in length of the ascending line or should be optionally replaceable by a piston rod that compensates the change in length of the ascending line.

It is also appropriate to interchangeably hold the discharge line, the ascending line, as well as the cylinder, rigidly connected to the housing of the discharge valve and the pump piston introduced thereinto at the reservoir with a cover, a plate or the like provided at the discharge line, for example with a collar, and to provide the cover or the plate with a guide member for the piston rod connected to the pump piston.

Further, a filter can be removably attached, preferably with a bayonet-type closure, to the cylinder in alignment direction of the pump piston and the discharge line with applied cover, the component parts of the ascending line, as well as the cylinder with applied valve housing can be manufactured of an impact-resistant plastic.

When a conveying pump is fashioned according to the invention, wherein the ascending line allocated thereto is fashioned variable in length, then it is possible to adapt the conveying pump to reservoirs dimensioned with different heights and to suction in the liquid to be conveyed in the respective bottom region of the reservoir without the conveying behavior of the pump being deteriorated. On the contrary, the distance of the conveying pump from the discharge line can be varied without difficulty on the basis of a variation in length of the ascending line; the conveying pump can thus be easily introduced into reservoirs that differ in height.

It is also advantageous that the ascending line is composed of only two component parts and that the annular gap deriving between these can be unproblemmatically sealed in the connection pieces forming the ascending line. Further, the connection pieces can be dependably locked by the adjusting lever attached to the valve housing of the discharge valve or to the discharge line; this connection can nonetheless be released easily and in a short time in order to lengthen or shorten the ascending line. The conveying pump can consequently be easily taken apart, so that the component parts thereof can be unproblematically cleaned and/or wear parts can be easily replaced as needed. A high dependability as well as a versatile employability are consequently always established.

BRIEF DESCRIPTION OF THE DRAWINGS

The drawings show an exemplary embodiment of the conveying pump fashioned in conformity with the invention together with modified embodiments, this being set forth in detail below. Thereby shown are.

DETAILED DESCRIPTION OF THE PREFERRED EMBODIMENTS

Figure 1:
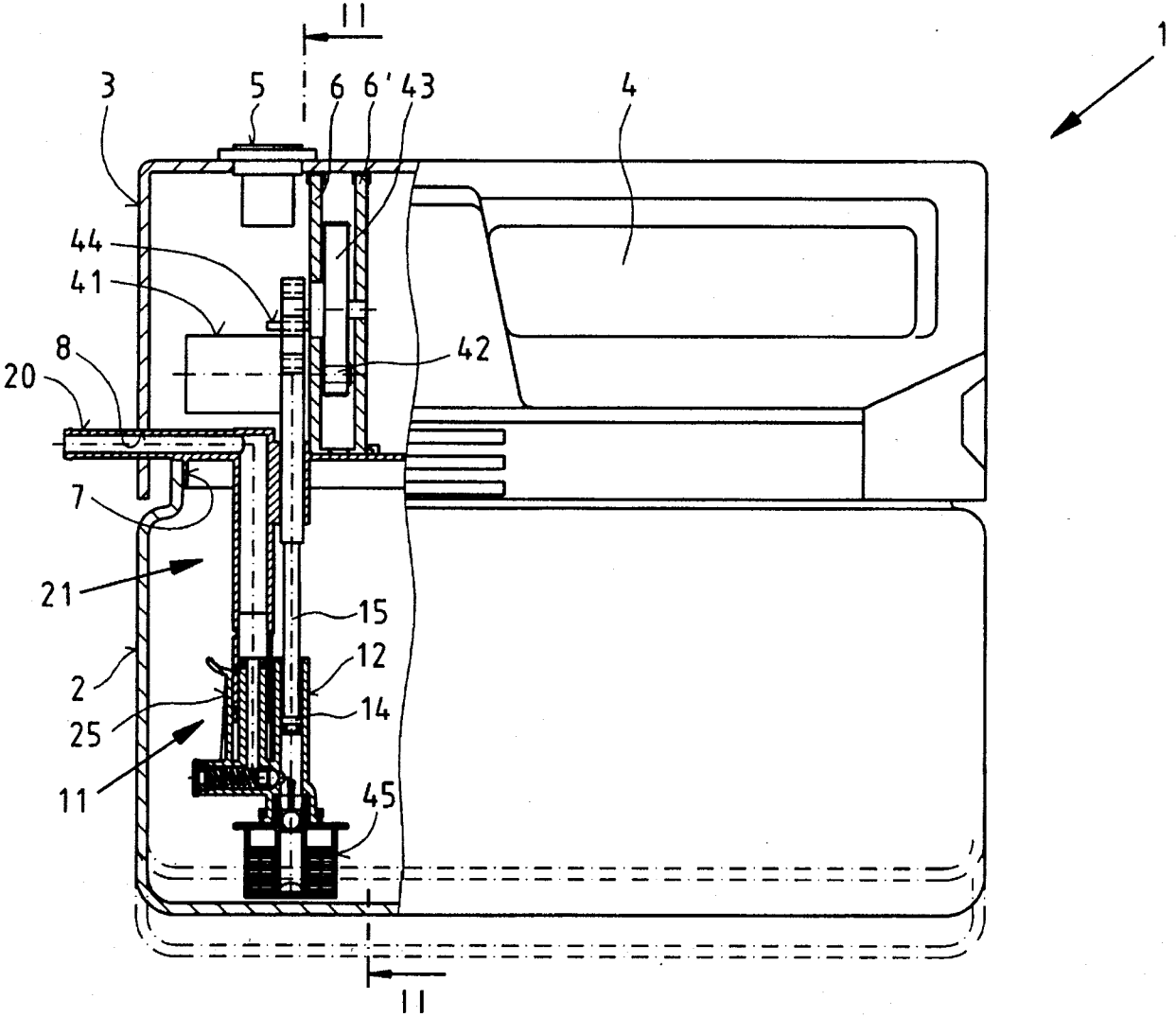
FIG. 1 is the front elevational and partial sectional view of the conveying pump introduced into a feed apparatus.
Figure 2:
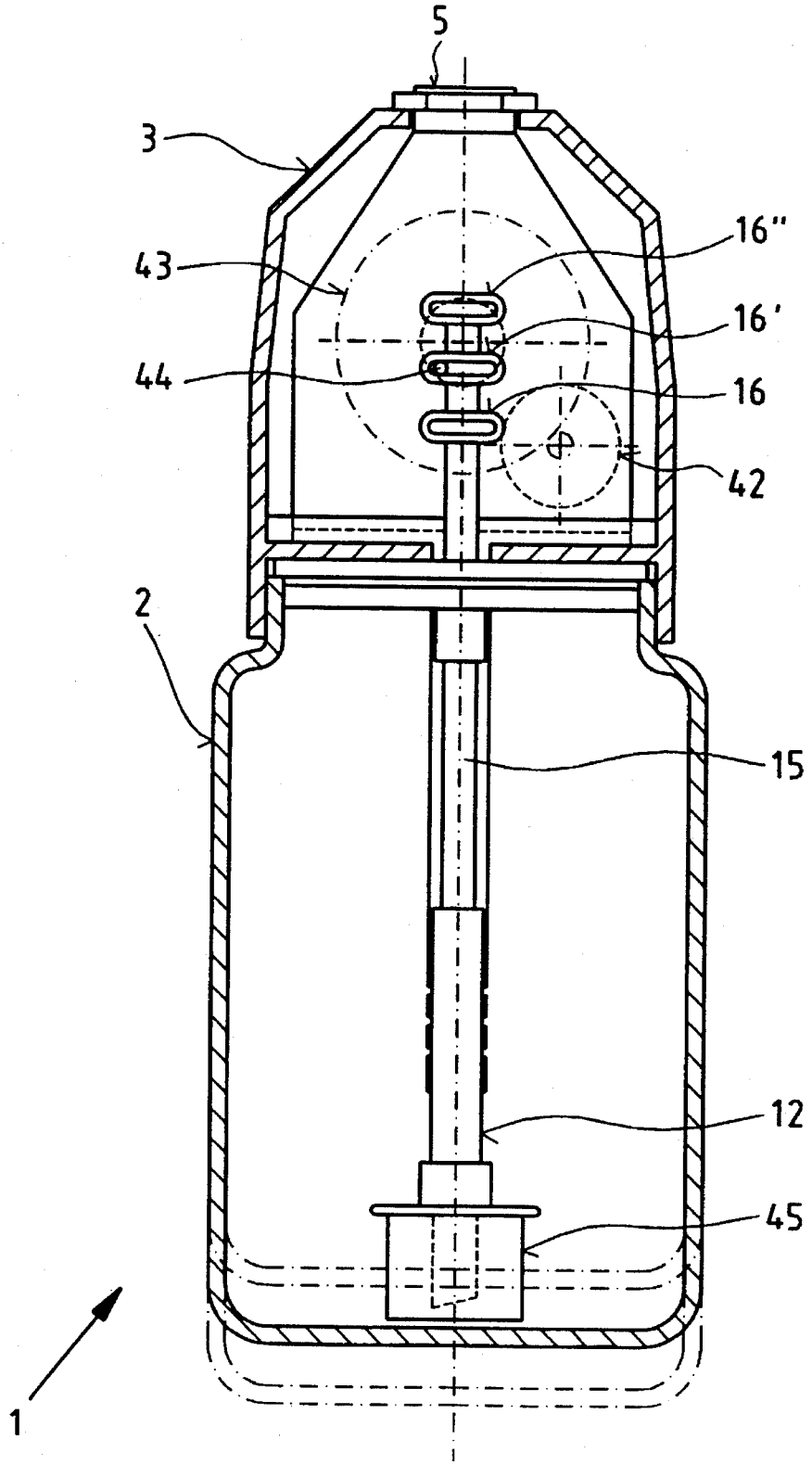
FIG. 2 is a sectional view of the feed apparatus of FIG. 2 taken generally along the line II—II of FIG. 1.

The feed device shown in FIGS. 1 and 2 and reference 1 serves the purpose of supplying a hand tool, for example an inside-feed paint roller or a brush with the medium to be processed, and is essentially composed of a reservoir 2 fashioned as lower part for the acceptance of the medium as well as of an upper part 3 detachably connected to the reservoir 2 into which a gripping opening 4 for transporting the feed device 1 is formed. The medium is supplied with a conveying pump 11 to a discharge line 20 to which a line leading to the hand tool (not shown) can be connected.

Figure 3:
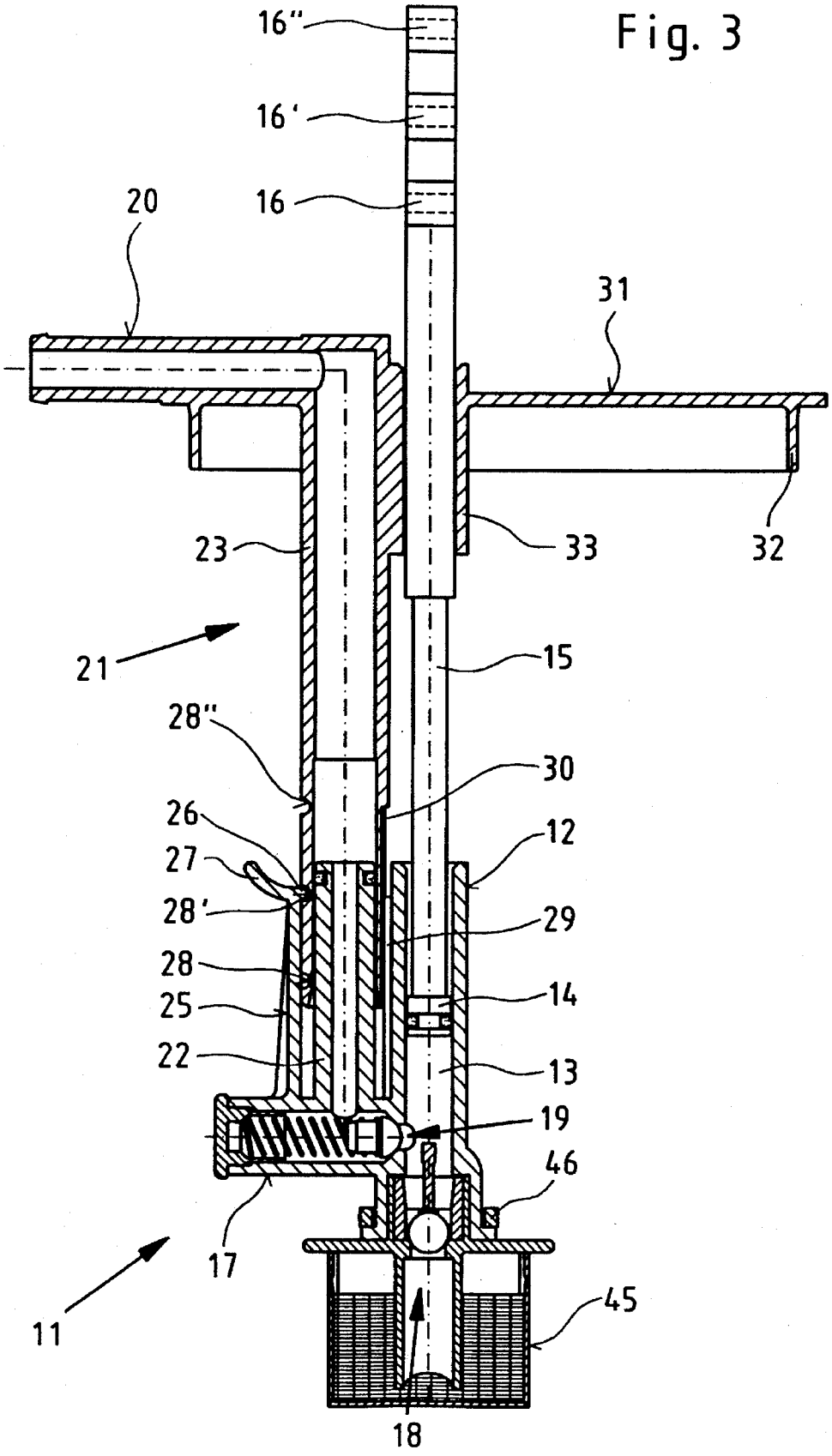
FIG. 3 is an enlarged sectional view of the conveying pump of the feed device according to FIG. 1 together with the allocated component parts.
Figure 4:
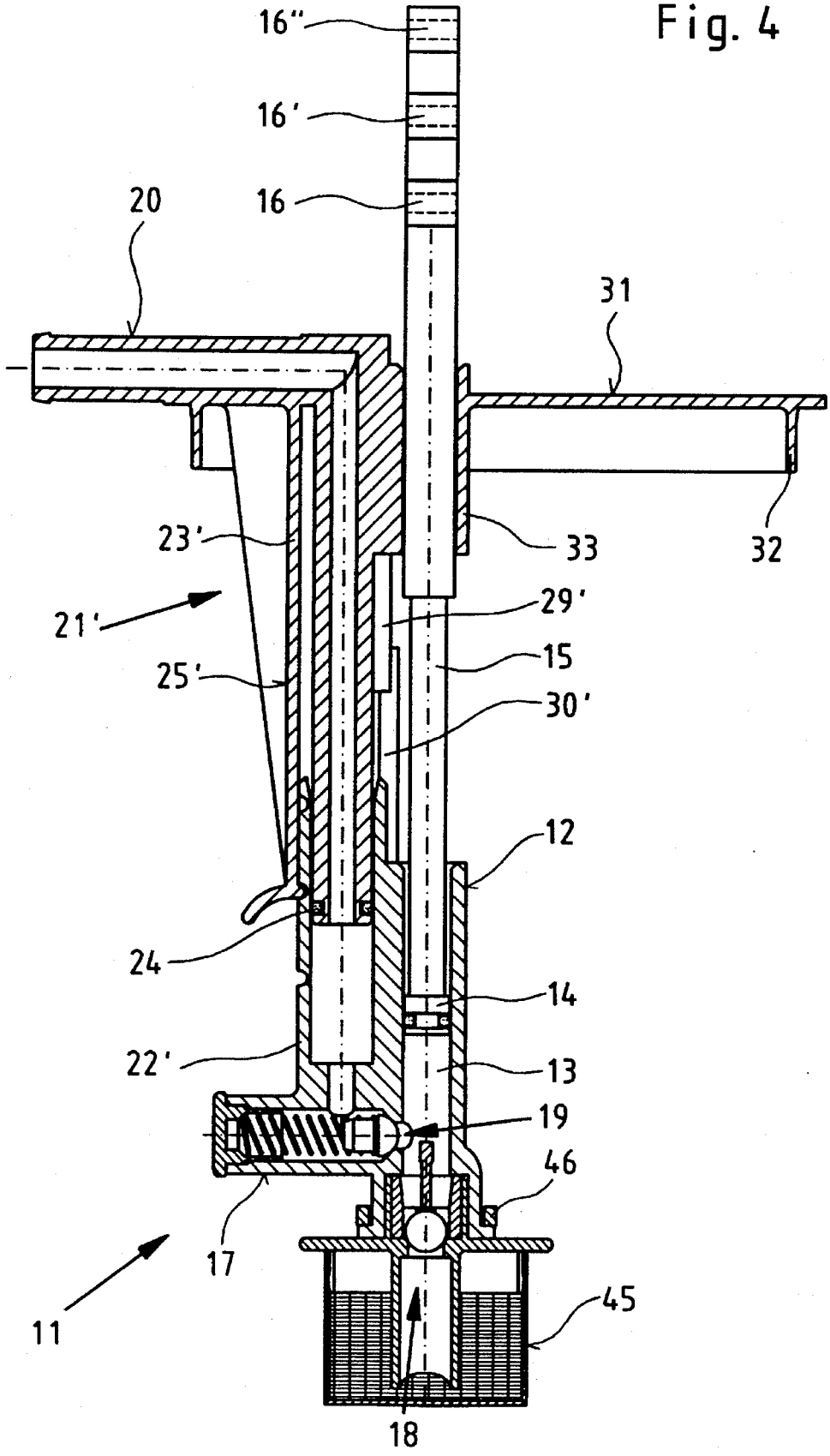
FIG. 4 is an enlarged sectional view of an alternate embodiment of the conveying pump of FIG. 1 with a different arrangement of the adjusting lever provided for locking the connection pieces that form the ascending line.

As may especially be derived from FIGS. 3 and 4, the conveying pump 11 comprises a cylinder 12 having a cylinder space 13 into which a piston pump 14 is introduced, and also comprises an admission valve 18 and a discharge valve 19. The admission valve 18 is directly introduced into the correspondingly fashioned cylinder 12. The discharge valve 19, by contrast, is provided in a valve housing 17 attached to the cylinder 12, the valve housing 17 being connected to the discharge line 20 via an ascending line 21. An electric motor 41 is provided for driving the pump piston 14, this electric motor 41 being capable of being switched on and off with a switch 5 attached in the upper part 3 and being supported in partitions 6 and 6' of the upper part 3. The electric motor 41 is connected in drive terms to a piston rod 15 of the pump piston 14 via gear wheels 42 and 43 as well as via a cam lever 44.

As a result of lifting motions of the pump piston 14, the rotational motion of the electric motor 41 is converted into an axial motion of the piston rod 15 with the cam lever 44, the medium to be processed is suctioned into the cylinder space 13 via a filter 45, which is secured to the cylinder 12 with the assistance of a bayonet-type closure 46, when the admission valve 18 is opened and the discharge valve 19 is closed, and is conveyed from this cylinder space 13 to the discharge line 20 that engages through an opening 8 formed in the upper part 3 when the admission valve 18 is closed and the discharge valve 19 opens.

In order to be able to adapt the conveying pump 11 to reservoirs dimensioned differently in height, these being entered with dot-dash lines in FIGS. 1 and 2, the ascending line 21, 21' is fashioned variable in length. In order to accomplish this in a simple way that is nonetheless operationally reliable, connection pieces 22 and 23 or, respectively, 22' and 23' are attached to the vale housing 17 as well as to the discharge line 20, these connection pieces being adjustably arranged inside one another and being capable of being locked at different heights. An adjusting lever 25 or 25' serves this purpose, this being applied according to FIG. 3 to the valve housing 17 and, according to FIG. 4, to the discharge line 20. The adjusting lever 25 or 25' pressing against the connection piece 23 or the connection piece 22' with pre-stress comprises a catch-nose 26 that can optionally engage into the notchings 28, 28' and 28" worked into the connection piece 23 or the connection piece 22'. The adjusting lever 25 or 25' is also equipped with a gripping member 27 in order to press the lever down and, thus, release the interlock.

For varying the length of the ascending line 21 or 21', consequently, the adjusting lever 25 or 25' need merely be deformed such that the catch-nose 26 thereof no longer engages into the notching 28' and the two connection pieces 22, 23 or 22', 23' can then be adjusted relative to one another. The connection pieces 22, 23 or 22', 23', between which a seal 24 is introduced for sealing the resultant annular gap, are in turn locked by engaging the catch-nose 26 into the notching 28 or 28".

So that the connection pieces 22, 23 or 22', 23' are guided in anti-twist fashion, a web 29 is applied to the cylinder 12 in the embodiment of FIG. 3, this web 29 engaging into a longitudinal channel 30 formed in the connection piece 23. In the modified embodiment of FIG. 4, by contrast, a web 29' that is guided in a longitudinal channel 30' of the connection piece 22' is attached to the connection piece 23'.

So that the cylinder space 13 of the cylinder 12 allocated to the pump piston 14 remains the same, even given a variation in length of the ascending line 21 or 21', the piston rod 15 is provided with three attachment eyelets 16, 16' and 16" for the cam lever 44, these eyelets being arranged at distances from one another that correspond to the distances between the notchings 28, 28' and 28". Not only is the rotational movement of the cam lever 44 converted into the linear lifting motions of the piston rod 15 in this way, but the position of the pump piston 14 can also be adapted to the respective length of the ascending line 21.

In the illustrated exemplary embodiment, the conveying pump is interchangeably introduced into the reservoir 2. To this end, the latter is provided with an opening 7 and a plate-like cover 31 is applied to the discharge line 20, this cover 31 comprising an all around collar 32 that engages into the opening 7. A guide member 33 for the piston rod 15 of the pump piston 14 is also attached to the cover 31. When the conveying pump 11 is taken out, the component parts being capable of being economically manufactured of impact resistant plastic, the medium to be processed can thus be unproblemmatically filled into the reservoir 2.

Figure 5:
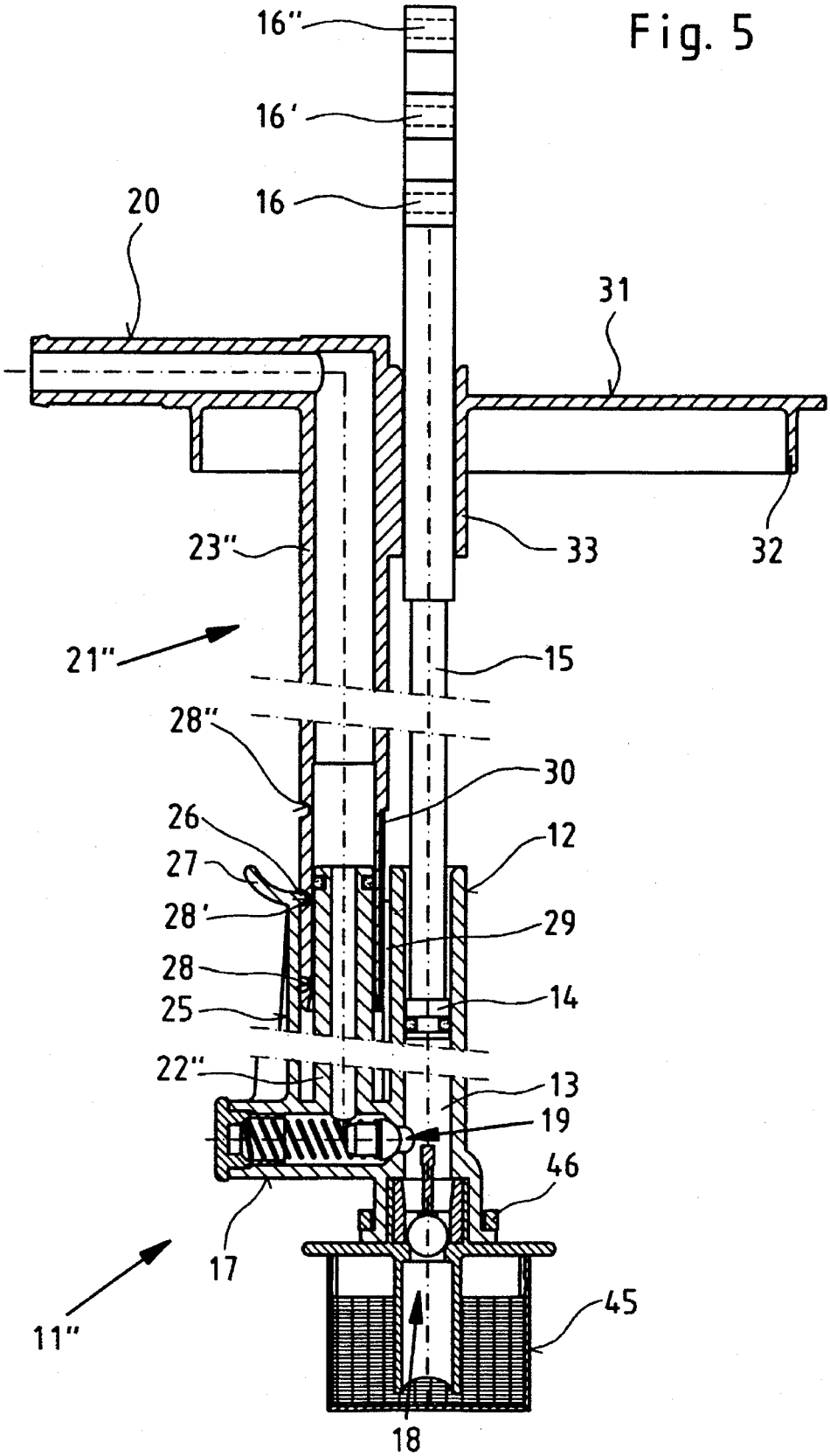
FIG. 5 is an enlarged sectional view of the conveying pump of FIG. 3 with connection pieces to be optionally dimensioned of different lengths for varying the length of the ascending line.

The distance between the filter 45 to be arranged in the bottom region of a reservoir 2 and the discharge line 20 and, thus, the length of the ascending line 21", however, can also be varied, as shown in the case of the conveying pump 11" of FIG. 5 in that at least one of the connection pieces 22" and 23" forming this ascending line as well as the potentially appertaining component parts are optionally dimensioned different in length. This possibility of varying the length of the ascending line 21" is illustrated by the illustrated parting lines.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A pump for conveying material comprising:

a cylinder introducible into a reservoir, said cylinder being provided with an admission valve and a discharge valve, said discharge valve located in a valve housing;

a pump piston arranged in said cylinder and driveable by a motor via a drive element;

an ascending line connected to said valve housing, said ascending line having a longitudinal axis;

a discharge line connected to said ascending line to receive said conveyed material from said ascending line;

said ascending line being formed of two or more sections adjustable relative to one another along said longitudinal axis, said sections including means for releasably locking said sections at different heights along said longitudinal axis for varying a length of said ascending line.

2. A conveying pump according to claim 1, wherein the sections of the ascending line are formed by connection pieces that are arranged in alignment with one another to be plugged inside one another and that are attached to the valve housing of the discharge valve and to the discharge line.

3. A conveying pump according to claim 1, further comprising a piston rod connected to the pump piston including means for selectively connecting said piston rod at different heights to the drive element of the motor or means for substituting a piston rod having a different length that compensates a variation in length of the ascending line.

4. A conveying pump according to claim 1, wherein the discharge line, the ascending line, as well as the cylinder connected to the valve housing of the discharge valve and the pump piston introduced thereinto are interchangeably held at the reservoir with a cover plate provided at the discharge line, by means of a collar.

5. A conveying pump according to claim 4, wherein the cover plate is provided with a guide member for the piston rod connected to the pump piston.

6. A conveying pump according to claim 4, wherein the discharge line together with the cover plate, the component parts of the ascending line, as well as the cylinder with the valve housing are manufactured of an impact-resistant plastic.

7. A conveying pump according to claim 1, wherein a filter is removably attached to the cylinder in alignment direction of the pump piston.

8. A pump for conveying material comprising:

a cylinder introducible into a reservoir, said cylinder being provided with an admission valve and a discharge valve, said discharge valve located in a valve housing;

a pump piston arranged in said cylinder and driveable by a motor via a drive element;

an ascending line connected to said valve housing;

a discharge line connected to said ascending line to receive said conveyed material from said ascending line;

said ascending line being formed of two or more sections constructed and arranged to plug inside one another and to lock to one another, at least one thereof being dimensioned different in length from the other.

9. A conveying pump according to claim 8, wherein the sections of the ascending line are formed by connection pieces that are arranged in alignment with one another and constructed and arranged to plug inside one another and that are attached to the valve housing of the discharge valve and to the discharge line.

10. A conveying pump according to claim 8, wherein the sections that form the ascending line are guided displaceably inside one another in anti-twist fashion.

11. A conveying pump according to claim 8, further comprising a piston rod connected to the pump piston including means for selectively connecting said pump piston at different heights to the drive element of the motor or means for substituting a piston rod having a different length that compensates a variation in length of the ascending line.

12. A conveying pump according to claim 8, wherein the discharge line, the ascending line, as well as the cylinder connected to the valve housing of the discharge valve and the pump piston introduced thereinto are interchangeably held at the reservoir with a cover plate provided at the discharge line, by means of a collar.

13. A conveying pump according to claim 12, wherein the cover plate is provided with a guide member for the piston rod connected to the pump piston.

14. A conveying pump according to claim 12, wherein the discharge line together with the cover plate, the component parts of the ascending line, as well as the cylinder with the valve housing are manufactured of an impact-resistant plastic.

15. A conveying pump according to claim 12, wherein a filter is removably attached to the cylinder in alignment direction of the pump piston.

16. A pump for conveying material comprising:

a cylinder introducible into a reservoir, said cylinder being provided with an admission valve and a discharge valve, said discharge valve located in a valve housing;

a pump piston arranged in said cylinder and driveable by a motor;

an ascending line connected to said valve housing;

a discharge line connected to said ascending line to receive said conveyed material from said ascending line;

said ascending line being formed of two or more sections and including means for varying a length of said ascending line.

17. A pump for conveying material comprising:

a cylinder introducible into a reservoir, said cylinder being provided with an admission valve and a discharge valve, said discharge valve located in a valve housing;

a pump piston arranged in said cylinder and driveable by a motor;

an ascending line connected to said valve housing, said ascending line having a longitudinal axis;

a discharge line connected to said ascending line to receive said conveyed material from said ascending line;

said ascending line being formed of two or more sections adjustable relative to one another along said longitudinal axis, said sections including means for releasably locking said sections at different heights along said longitudinal axis for varying a length of said ascending line; and means for locking said sections together, said locking means comprising an adjusting lever that is elastically deformable, extends in the direction of the ascending line and is attached to the valve housing of the discharge valve, said adjusting lever having a catch nose that engages into a notching formed in an outside surface of one of the at different selected heights.

18. A conveying pump according to claim 17, wherein the adjusting lever has a side lying opposite the catch nose provided with a gripping member which extends at an angle therefrom.

19. A pump for conveying material comprising:

a cylinder introducible into a reservoir, said cylinder being provided with an admission valve and a discharge valve, said discharge valve located in a valve housing;

a pump piston arranged in said cylinder and driveable by a motor;

an ascending line connected to said valve housing, said ascending line having a longitudinal axis;

a discharge line connected to said ascending line to receive said conveyed material from said ascending line;

said ascending line being formed of two or more sections adjustable relative to one another along said longitudinal axis, said sections including means for releasably locking said sections at different heights along said longitudinal axis for varying a length of said ascending line, wherein the sections that form the ascending line are guided displaceably inside one another in anti-twist fashion; and a web that projects from the cylinder and engages into a longitudinal channel formed in an outside surface of the sections attached to the discharge line to provide said anti-twist guidance.

20. A pump for conveying material comprising:

a cylinder introducible into a reservoir, said cylinder being provided with an admission valve and a discharge valve, said discharge valve located in a valve housing;

a pump piston arranged in said cylinder and driveable by a motor;

an ascending line connected to said valve housing;

a discharge line connected to said ascending line to receive said conveyed material from said ascending line;

said ascending line being formed of two or more sections constructed and arranged to plug inside one another and to lock to one another, at least one thereof being dimensioned different in length from the other; and means for locking said sections together, said locking means comprising an adjusting lever that is elastically deformable, extends in the direction of the ascending line and is attached to the valve housing of the discharge valve, said adjusting lever having a catch nose that engages into a notching formed in an outside of one of the sections at different selected heights.

21. A conveying pump according to claim 20, wherein the adjusting lever has a side lying opposite the catch nose provided with a gripping member which extends at an angle therefrom.

22. A pump for conveying material comprising:

a cylinder introducible into a reservoir, said cylinder being provided with an admission valve and a discharge valve, said discharge valve located in a valve housing;

a pump piston arranged in said cylinder and driveable by a motor;

an ascending line connected to said valve housing;

a discharge line connected to said ascending line to receive said conveyed material from said ascending line;

said ascending line being formed of two or more sections constructed and arranged to plug inside one another and to lock to one another, at least one thereof being dimensioned different in length from the other, wherein the sections that form the ascending line are guided displaceably inside one another in anti-twist fashion; and a web that projects from the cylinder and engages into a longitudinal channel formed in an outside surface of the section attached to the discharge line to provide said anti-twist guidance.

* * * * *